US006656675B2

(12) United States Patent
Jezequel et al.

(10) Patent No.: US 6,656,675 B2
(45) Date of Patent: Dec. 2, 2003

(54) METHOD OF PREPARING A SILVER HALIDE PHOTOGRAPHIC EMULSION

(75) Inventors: Pierre-Henri Jezequel, Lyons (FR); Bruno C. Barillon, Versailles (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/184,453

(22) Filed: Jun. 28, 2002

(65) Prior Publication Data

US 2003/0013052 A1 Jan. 16, 2003

(30) Foreign Application Priority Data

Jul. 4, 2001 (FR) ..... 01 08831

(51) Int. Cl.[7] ..... G03C 1/035
(52) U.S. Cl. ..... 430/569
(58) Field of Search ..... 430/569

(56) References Cited

U.S. PATENT DOCUMENTS

| | | | | |
|---|---|---|---|---|
| 3,206,313 | A | 9/1965 | Porter et al. | 430/138 |
| 3,317,322 | A | 5/1967 | Porter et al. | 430/567 |
| 3,505,068 | A | 4/1970 | Beckett et al. | 430/138 |
| 4,210,450 | A | 7/1980 | Corben | 430/567 |
| 4,433,048 | A | 2/1984 | Solberg et al. | 430/434 |
| 5,358,840 | A | 10/1994 | Chaffee et al. | 430/567 |
| 5,667,954 | A | 9/1997 | Irving et al. | 430/567 |
| 5,840,475 | A | 11/1998 | Levy et al. | 430/619 |
| 6,043,019 | A | 3/2000 | Jagannathan et al. | 430/569 |
| 6,242,172 | B1 | 6/2001 | Budz et al. | 430/567 |

*Primary Examiner*—Hoa Van Le
(74) *Attorney, Agent, or Firm*—Andrew J. Anderson

(57) ABSTRACT

A method for the preparation of silver haloiodide photographic emulsions, in particular the preparation of tabular grains haloiodide photographic emulsions. The method comprises the steps of adding pulsed jets of iodide salt and silver salt to a host emulsion.

9 Claims, 2 Drawing Sheets

METHOD OF PREPARING A SILVER HALIDE PHOTOGRAPHIC EMULSION

FIELD OF THE INVENTION

The present invention relates to a method for preparing a silver haloiodide photographic emulsion. More particularly by, the invention concerns a method of preparing a tabular grain silver bromoiodide emulsion.

BACKGROUND OF THE INVENTION

In photography, especially for color pictures, silver halide emulsions are commonly used that contain a certain proportion of iodide. The silver bromoiodide grains are made up of silver bromide crystals in which the silver iodide can theoretically be incorporated up to the limit of its solubility in the silver bromide, i.e., up to about 40 mole % depending on the temperature at which the grain was formed. In most cases, the percentage of iodide lies between 0.1 and 10 mole %, and more particularly between 0.5 and 5 mole %. The percentages of halide are given relative to the silver present in the emulsion. The percentages of iodide in the silver bromoiodide emulsions are the result of a compromise between the advantages provided by the iodide (better formation of the latent image, better natural speed, better adsorption of additives) and the disadvantages arising from the presence of iodide (inhibition of development, resistance to chemical sensitization). The localization of the iodide in the grain also influences the photographic characteristics of the emulsion. This localization of the iodide in the grain is determined by the conditions of preparation. In general, for silver haloiodide emulsions intended for negative or reverse color photographic products the iodide is added in a range between 60 to 80% of the total precipitation of the emulsion. Silver iodide is much less soluble than silver bromide and silver chloride. Accordingly, it is possible to distribute the iodide throughout the grain using double jet precipitation, where the iodide and the bromide are added together in the reactor at the same time as the silver salt, or using triple jet precipitation, with a silver salt jet and two simultaneous jets of bromide and iodide respectively. However, with this method, it is not possible to form zones within the grain that have high concentrations of iodide. To obtain zones with high iodide concentrations iodide needs to be added while the addition of bromide is stopped or slowed. The iodide can be added in the form of seeds or fine grains of silver iodide, or in a controlled manner as a solution, for example of sodium or potassium iodide. When silver iodide seeds are used these must obviously be prepared and stored separately during use. The introduction of separate soluble iodide solutions during the precipitation has also been tried. When separate iodide solutions are used during precipitation, they have to be introduced into the reactor at low flow rates, less than 20 ml/minute and even less than 10 ml/minute, in order to optimize the formation of silver iodide on the silver halide already precipitated, and prevent the formation of grains with undesired shapes. In addition, if too much iodide is added in a very short time, then the grains may be destroyed. These conditions do not favor an industrial use of this method.

Various methods of the types stated above, designed to incorporate iodide into silver halide grains are described, for example, in U.S. Pat. Nos. 3,206,313; 3,317,322; 3,505,068 and 4,210,450. Some of these references concern tabular grain silver haloiodide emulsions. Tabular silver halide grains are grains that possess two main parallel faces that are appreciably greater in surface area than the other faces of the grain. The tabular grain shape is expressed by the aspect ratio of the grain, which is the ratio of the equivalent circular diameter (ECD) to the thickness (t), or distance between the two main parallel faces. A grain is considered tabular if its aspect ratio (ECD): t is greater than 2. An emulsion is said to be 'tabular grain' when at least 50%, and preferably at least 70% and even at least 90% of the total projected surface of the grains of the emulsion is composed of tabular grains.

Because tabular grain emulsions are more and more widely used in photography, efforts have been made to optimize the introduction of iodide in the emulsions, as described for example in U.S. Pat. Nos. 4,433,048; 5,358,840 and 5,840,475. In another reference (U.S. Pat. No. 5,667,954), a method is described for preparing a silver bromoiodide emulsion with tabular grains whereby a 'host' emulsion of silver bromide is first precipitated, to which is then added a solution of iodide ions without introducing a silver salt. This method aims to obtain a localization of silver iodide in certain zones of the grain.

However, the methods stated above all present various disadvantages, as indicated, making their industrial application difficult, especially as regards tabular grain emulsions.

Therefore, it is desirable in the art to have a method that makes it possible to overcome these disadvantages.

SUMMARY OF THE INVENTION

The present invention provides a method of preparing a silver haloiodide photographic emulsion which allows a robust and efficient way to introduce iodide in the emulsion and to monitor the localization of the iodide in the emulsion. More particularly, the invention provides a method for preparing a tabular grain haloiodide photographic emulsion.

The present invention for preparing a silver haloiodide emulsion, comprises the steps of (i) preparing a silver halide host emulsion in a reactor vessel, and (ii) simultaneously adding jets of soluble silver salt and iodide salt solutions to the reactor vessel to precipitate silver iodide onto the silver halide host emulsion, the jets being added in at least two pulses separated by a pause, where the respective flow rates of the silver salt and the iodide salt solutions added are at least $V/Vo \times 100$ ml/minute each during the pulses, wherein Vo is 18 l and V is the total volume of precipitated emulsion in the reactor vessel.

In one aspect of the method of the invention, a part of the iodide in the iodide jet of step (ii) is replaced by bromide during at least one pulse.

In yet another aspect of the invention, the method comprises the steps of:

(i) precipitating a host tabular grain silver bromide, silver chloride, or silver bromochloride emulsion in a reactor vessel, and (ii) simultaneously adding jets of soluble silver salt and iodide salt solutions to the reactor vessel to precipitate silver iodide onto the host emulsion, the jets being added in at least two pulses separated by a pause, where the silver salt jet and the iodide salt jet have a flow rate of at least $V/Vo \times 100$ ml/minute each during the pulses, wherein Vo is 18 l and V is the total volume of precipitated emulsion in the reactor vessel.

DETAILED DESCRIPTION OF THE INVENTION

Figure 1:
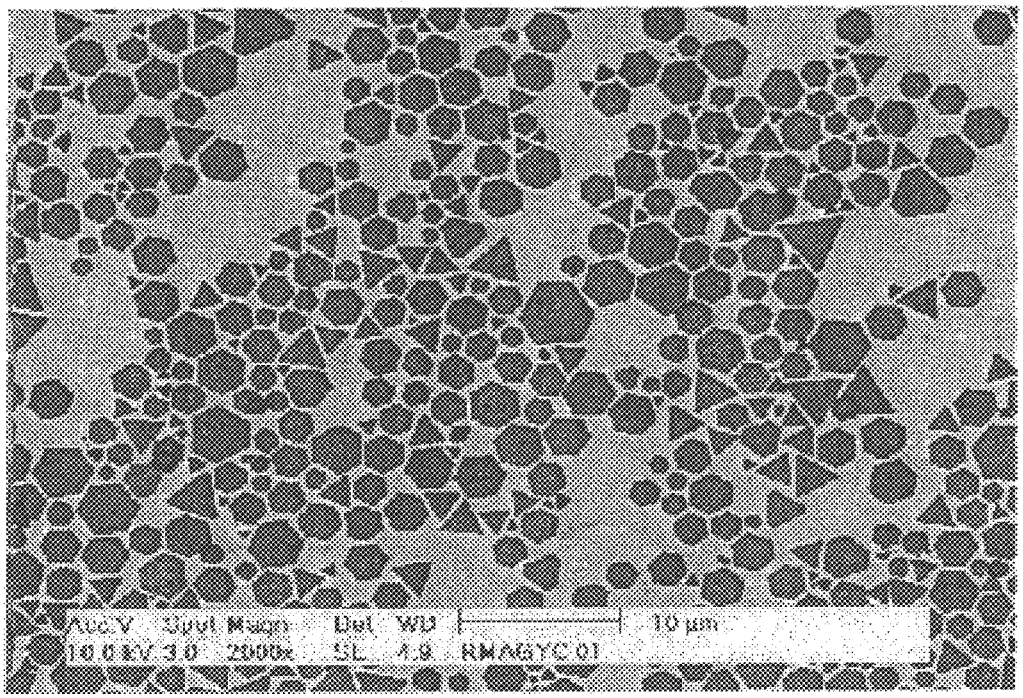
FIG. 1 shows a micrograph of a control silver bromoiodide emulsion.

To obtain high sensitivities it is generally recommended that silver bromoiodide emulsions be used in which the grains have a central part or 'core' that is poor in iodide, or substantially free of iodide, the iodide being located predominantly at the surface or periphery of the grain. It is also recommended that the silver bromoiodide grains form a monodisperse population. The method of the present invention allows these conditions to be met. According to this method, a host emulsion preferably monodisperse of tabular grains of silver halide is first formed. A monodisperse emulsion is an emulsion whose grains form a population with a coefficient of variation (COV) lower than 20% and preferably lower than 10%. The methods for making such monodisperse silver halide emulsions are known and are described for example in U.S. Pat. Nos. 5,147,771; 5,147,772; 5,147,773; 5,210,013 and 5,171,659. If the host emulsion contains iodide, then its iodide content should preferably be less than 1 mole %. The iodide content of the host emulsion can be adjusted by routine methods according to the quantity of iodide which is then added by means of the pulses in the method of the invention.

To obtain these pulses, the iodide can be introduced as an aqueous solution of a soluble iodide salt. In general, alkali metal iodides are preferred. In contrast to some of the methods of prior art, the iodide is not introduced in the form of fine grains of silver iodide. Also, the soluble silver salt is introduced at the same time as the soluble iodide is introduced into the precipitation reactor. The introduction of iodide into the silver halide grains is governed by the equilibrium equation $$Ag^{+}+X^{-}\rightarrow AgX$$

where X stands for a halide ion. In this relation, most of the silver and halide ions are in insoluble form at equilibrium. However, the equilibrium is dynamic, and in particular an exchange of iodide ions still occurs between the left and right hand sides of the equilibrium. At any given temperature, the activities of the silver and halide ions at equilibrium satisfy the equation $$K_S=[Ag^{+}][X^{-}]$$

where $K_S$ is the solubility product of the silver halide. In practice, the negative logarithms of the silver and halide ion activities (pAg and pX) are used, which are linked to $K_S$ by the equation $$-logK_S=pAg+pX$$

Hence, the higher the value of $-\log K_S$ is, the lower is the solubility of the halide. Some $-\log K_s$ values of silver halides are given in the Table below.

TABLE I

| | $-\log K_S$ | | |
|---|---|---|---|
| Temperature ° C. | AgCl | AgBr | AgI |
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

This table shows for example that at 40° C. silver chloride is a million times more soluble in water than silver iodide. This table also shows that the solubility of halides is temperature-dependent. This solubility also depends on the vAg (or the pAg). The method of the invention allows iodide to be introduced into the tabular grains at high iodide jet flow rates that in the methods of prior art would shatter the grains.

According to the invention, the iodide salt is introduced simultaneously with a silver salt using a sequence of pulses (at least two pulses), and preferably between 5 and 10 pulses, each pulse being separated from the following one by a pause of preferably at least 15 seconds and more preferably of between 1 and 3 minutes, according to the flow rates and stirring conditions. These simultaneous pulses allow simultaneous addition of iodide and soluble silver salt. The silver salt and iodide salt jets used for the pulses have a flow rate of at least V/Vo×100 ml/minute, during the pulses; wherein Vo is 18 l and V is the total volume of precipitated emulsion in the reactor vessel. Preferably, the flow rate is in the range of from V/Vo×150 to V/Vo×500 ml/minute and most preferably in the range of from V/VO×350 to V/Vo×300 ml/minute. It will be understood that the flow rate can be finely tuned to the desired value depending on the molar concentration of the salt jets, the number and the duration of pulses The pulses are preferably performed at a stage where from 50 to 80 mole % of silver has been added, based on the total for the precipitation of the silver haloiodide emulsion, and advantageously between 65 and 75 mole % of that quantity. If the pulses are applied before 50 mole % of the total silver has been added, then the aspect ratio of the tabular grains can increase (the grains are thicker). If the pulses are applied after 80 mole % of the total silver has been added, then the tabular grains obtained have a poorer developability. Thus, by adding both soluble iodide and a soluble silver salt in successive pulses, silver iodide is added to the silver halide grains already formed, and the small crystals formed during each pulse can re-dissolve during the pause between successive pulses.

To obtain the speeds required for taking pictures, grains containing less than 10 mole %, preferably less than 5 mole % and even less than 3 mole % of iodide are generally needed. Preferably, the iodide is distributed in such a way that it is localized just below the surface of the grain, close to the surface. In addition, to implement the method of the invention it is desirable for the quantity of iodide to be maintained below a limit beyond which the tabular grain structure would be destroyed. For this reason also, the iodide concentration in the grains is limited to 10 mole % relative to the total quantity of silver used to precipitate the grains. The minimum quantity of iodide introduced in the grains is generally 0.5 mole %, and preferably 1 mole %.

The operating procedure for the method of the invention causes the center of the tabular grains to contain less iodide than the periphery of the grains. The iodide profile of the grains, i.e., the variation in the iodide concentration from the center to the periphery of the grain, can be evaluated by slicing the grains with a microtome and examining the sections under a microscope. The methods of analysis are described for example by J. I. Goldstein in 'Introduction to Analytical Electron Microscopy', Plenum, N.Y. (1983) and by G. Cliff and G. W. Lorimer in J. Microscopy, 103:203 (1975). The variations in the iodide concentration can also be determined on the main faces or inside the tabular grains.

Beside the specific features of the method according to the invention, the preparation of the host emulsions can include conventional operations such as those described in Research Disclosure publication n°36544, September 1994, page 501, Chapter I, II, III. The preparation of the emulsions can include seeding and growth operations that are separated in time and space, for example operations carried out in separate reactors. The dispersion medium used for the preparation of the emulsions is essentially made up of a hydrophilic colloid such as gelatin, de-ionized gelatin, modified gelatin, for example phthalylated gelatin, or oxidized gelatin, for example gelatin containing less than 30 micromoles of methionine per gram. Such hydrophilic colloids are described for example in above-cited Research Disclosure, Chapter IIA. The method of preparation of the host emulsion conventionally comprises a seeding step followed by a physical ripening step. Ripening agents can be used, such as those described for example in Research Disclosure, publication 36544, September 1994, page 504. An advantageous ripening agent is for example ethanolamine, as described in U.S. Pat. Nos. 5,246,826 and 5,246,827. The seeds then undergo a conventional growth step. The precipitations are carried out using conventional methods, in particular double jet and triple jet methods. Conventionally, a jet of soluble halide can be used, made up of sodium or potassium bromide and possible another soluble alkali metal halide with concentrations ranging, for example, between 0.5 M and 5.5 M, and preferably between 2 M and 5 M. A jet of soluble silver salt is also used, with a concentration close to that of the halide jet. The medium is stirred, for example, with a device of the type described in Research Disclosure n°38213, February 1996, pages 111–114.

The emulsions can be sensitized chemically and spectrally as described in above-cited Research Disclosure, Chapter IV and V. The emulsions can contain conventional additives such as anti-UV compounds, brighteners, antifoggants, stabilizers, and light-absorbent or light-reflective agents as described in above-cited Research Disclosure, Chapter VI, VII, VIII. The emulsions can also contain other additives such as agents that modify the mechanical or physical properties of the layers, such as those described in above-cited Research Disclosure, Chapter IX.

The invention is illustrated by the following examples.

EXAMPLE 1 (CONTROL)

A silver bromoiodide emulsion was prepared in accordance with the following steps.

(a) In a reactor of capacity 18 liters was placed at 40° C. an aqueous solution of 18 g of oxidized gelatin in 4.5 liters of water. To this solution was added, with stirring, 82 g of a 5 M solution of NaBr. The temperature of the solution was brought to 65° C. in 8 minutes.

(b) Seeding was then carried out by adding a solution of 67 g of $AgNO_3$ in 480 g of water.

(c) The seeds thus formed were then ripened by adding a solution of ammonium sulfate, followed by 2.5 M sodium hydroxide to adjust the pH to 9.5.

(d) After 5 minutes of ripening the pH was re-adjusted to 4.5 with 4 N $HNO_3$. The gelatin concentration was re-adjusted by adding 223 g of oxidized gelatin in 2 liters of water, and the vAg was then adjusted to 3.2 mV by addition of a 3 M solution of NaBr.

(e) Several successive growth steps were then implemented. For the first growth step were simultaneously added to the reactor: 220 ml of a 3 M solution of $AgNO_3$ and 230 ml of a 3 M solution of NaBr in 15 minutes with an accelerated flow rate of 7 to 22 ml/minute, with stirring. A second growth stage was then performed by simultaneously adding 375 ml of a 3 M solution of $AgNO_3$ and 400 ml of a 3 M solution of NaBr in 10 minutes with accelerated flow rates of 22 to 53 ml/minute. A third growth stage was then performed by simultaneously adding 757 ml of a 3 M solution of $AgNO_3$ and 800 ml of a 3 M solution of NaBr in 10 minutes with accelerated flow rates of 53 to 98 ml/minute. A fourth growth stage was performed by simultaneously adding 1,230 ml of a 3 M solution of $AgNO_3$ and 1,300 ml of a 3 M solution of NaBr in 10 minutes with accelerated flow rates of 98 to 160 ml/minute. A supplementary growth step was performed by simultaneously adding 248 ml of a 3 M solution of $AgNO_3$ and 300 ml of a 3 M solution of NaBr.

(f) 380 ml of a 3 M solution of NaBr was then added.

(g) 0.47 mole of silver was then added in the form of an emulsion of gelatin and silver iodide.

(h) The vAg was then adjusted to −43 mV by adding a 3 M solution of NaBr.

(i) 570 ml of a 3 M solution of $AgNO_3$ was added.

(j) 634 ml of a 3 M solution of $AgNO_3$ and 666 ml of a 3 M solution of NaBr were added simultaneously in 13 minutes. An emulsion was obtained composed of grains with an average equivalent circular diameter of 2.62 microns measured using the EFB (electric field birefringence) method, as described in the Proceedings of PARTEC 98, the $7^{th}$ European Symposium on Particle Characterization, Nuremberg, Germany 1998, page 23. FIG. 1 shows an EFB photomicrograph of this emulsion. The average thickness of the grains is 0.132 microns, measured by interferometry (reflectance of the emulsion layer, termed the CRT method).

(k) This emulsion was then optimally sensitized with sulfur and gold and spectrally sensitized in the green using a mixture of the N,N-diethylethanamine salt of 5-chloro-2-(2-((5-phenyl)-3-(3-sulfobutyl)-2(3H)-benzoxazolylidene)methyl)-1-butenyl)-3-(3-sulfopropyl)benzoxazolium and 3-ethyl-2-(2-((3-(2-((methylsulfonylamino)-2-oxoethyl)-2-(3H)-benzothiazolylidene)methyl) 1-butenyl-5-phenyl-benzoxazolium.

(l) A cyan dye-forming coupler was dispersed and mixed into the emulsion. The emulsion was then coated onto a support of transparent film at 11.25 Ag mg/$dm^2$ and 36 mg of gelatin per $dm^2$.

(m) The samples of film with their emulsion coat were exposed for 1/100 second through a density step chart through a Wratten™ 9 filter transmitting radiation of wavelength greater than 480 nm. This exposure was used to determine the green sensitivity of the emulsion layer.

(n) The samples were processed using the Kodak C-41 process.

EXAMPLE 2—(INVENTION)

The operating procedure described in Example 1 was repeated, but with the following modifications.

After step (f), step (g) was omitted, and 23 ml of a 2.65 M solution of $AgNO_3$ and 27 ml of a 2.5 M solution of KI were simultaneously added in 5 seconds, with stirring and while maintaining the temperature at 65° C. The mixture was left to stand for 2 minutes and this pulsed simultaneous addition of $AgNO_3$ and KI followed by a pause was repeated 7 times in the same conditions. After these pulses of $AgNO_3$ and KI the preparation and sensitization of the emulsion was completed and the emulsion was then exposed and processed as described in Example 1.

Figure 2A:
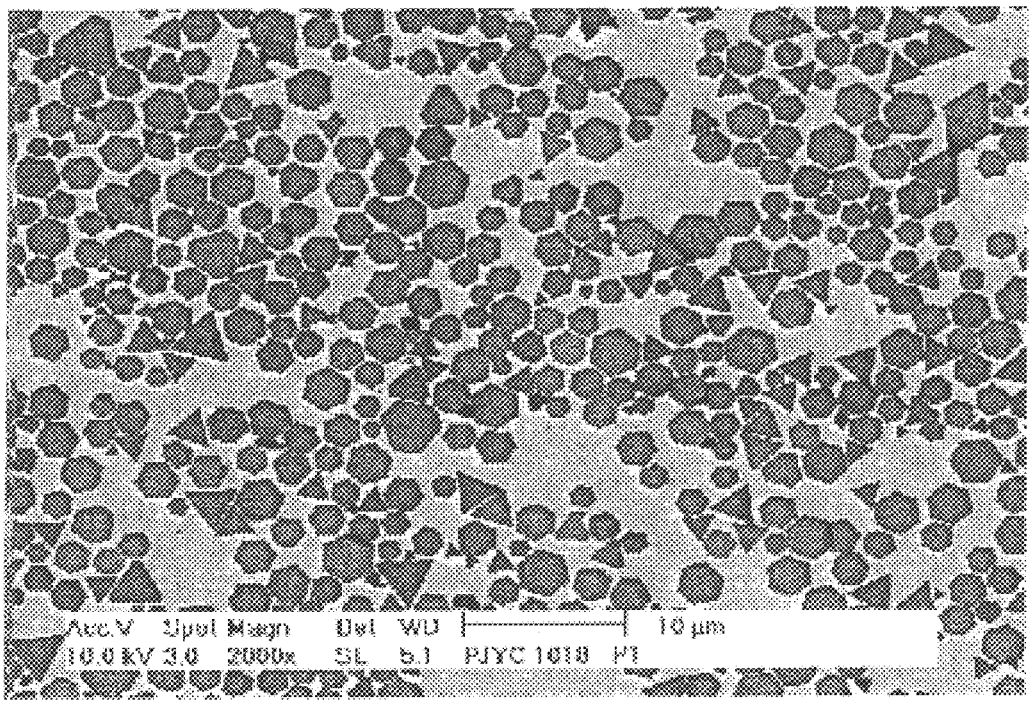
FIG. 2 shows micrographs of tabular silver bromoiodide grains obtained at different steps of the method of the invention.
Figure 2B:
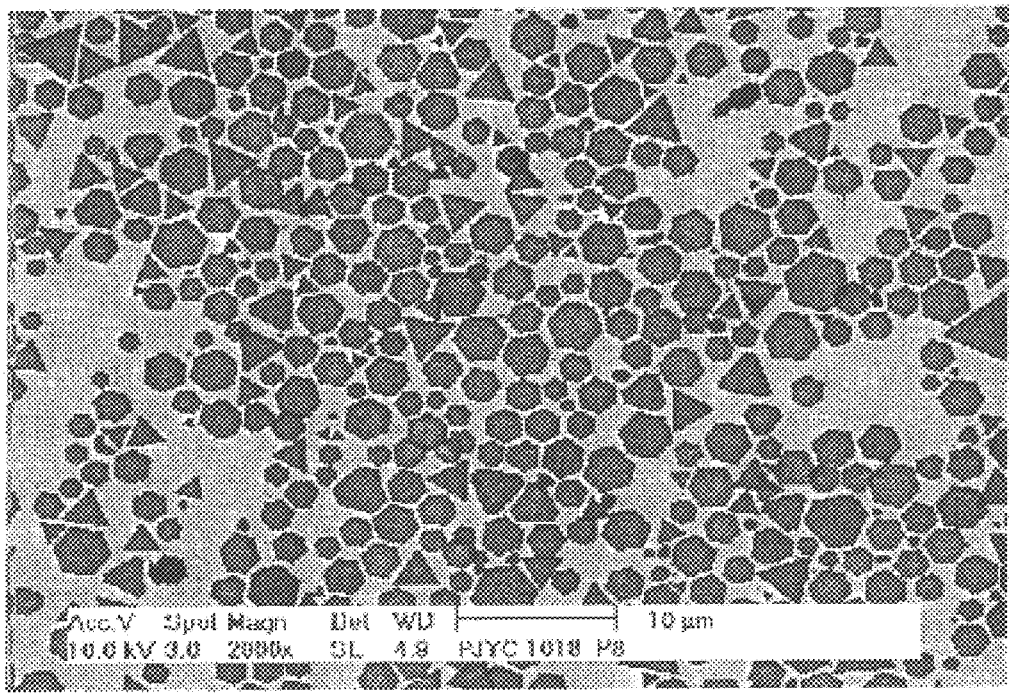
Figure 2C:
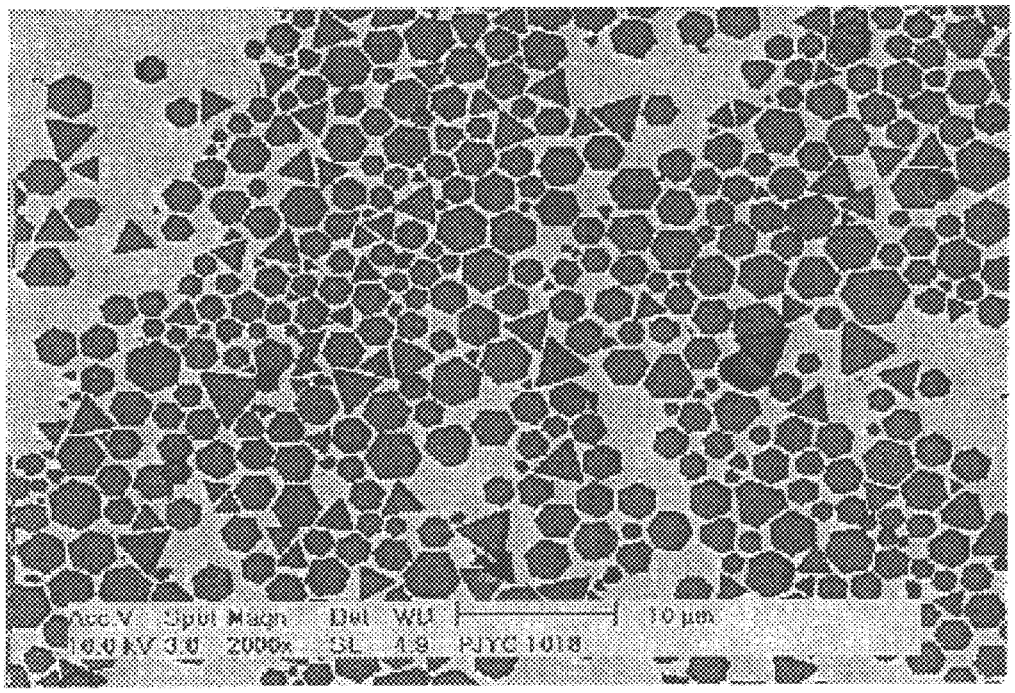

FIGS. 2A, 2B and 2C show EFB micrographs of the emulsion before and after the pulses. The equivalent circular diameter measured as in Example 1 was 2.47 microns. The average thickness, measured as in Example 1, was 0.138 microns. In addition, the pulses were found not appreciably to modify the grain shape or size distribution of the emulsions.

This emulsion yielded sensitometric results that were practically identical to those obtained with the control emulsion of Example 1. The method according to the invention thus affords emulsions of tabular grains in a more robust and more reliable way, by introducing the desired quantities of iodide while conserving the grain size distribution of the emulsion.

The invention has been described in detail with particular reference to certain preferred embodiments thereof, but it will be understood that variations and modifications can be effected within the spirit and scope of the invention.

What we claimed is:

1. A method for preparing a silver haloiodide emulsion, which method comprises the steps of (i) preparing a silver halide host emulsion in a reactor vessel, and (ii) simultaneously adding jets of soluble silver salt and iodide salt solutions to the reactor vessel to precipitate silver iodide onto the silver halide host emulsion, the jets being added in at least two pulses separated by a pause, where respective flow rates of the silver salt and the iodide salt solutions added are at least V/Vo×100 ml/minute each during the pulses, wherein Vo is 18 l and V is the total volume of emulsion precipitated in the reactor vessel.

2. The method of claim 1, wherein in step (ii), a part of the iodide in the iodide jet is replaced by bromide during at least one pulse.

3. The method of claim 2, wherein the concentration of the jets of silver salt and iodide plus bromide, during the pulses is at least 2 moles/l.

4. The method of claim 1, wherein the concentration of the jets of silver salt and iodide, during the pulses, is at least 2 mole/l.

5. The method of claim 1, wherein the pulses are effected after at least 50 mole % and at most 80 mole % of the total silver in the silver haloiodide emulsion has been precipitated.

6. The method of claim 1, wherein a pause lasting at least 15 seconds is inserted between successive pulses.

7. The method of claim 1, wherein step (i) comprises the precipitation of a host emulsion of silver bromide, silver chloride or silver bromochloride.

8. The method of claim 1, wherein step (i) comprises the precipitation of a host emulsion of tabular grains.

9. The method of claim 7, wherein step (i) comprises the precipitation of a host emulsion in which the tabular grains have an aspect ratio greater than 2:1 representing at least 50% of the total projected surface area of the grains.

* * * * *